US006698038B2

(12) United States Patent
Bastia et al.

(10) Patent No.: US 6,698,038 B2
(45) Date of Patent: Mar. 2, 2004

(54) WATERFALL FOOT MASSAGER

(75) Inventors: Paul A. Bastia, Cranston, RI (US); Alan E. Strick, Harrisville, RI (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 09/898,101

(22) Filed: Jul. 3, 2001

(65) Prior Publication Data

US 2003/0070222 A1 Apr. 17, 2003

(51) Int. Cl.[7] ..... A47K 3/022
(52) U.S. Cl. ..... 4/622; 601/157
(58) Field of Search ..... 4/622; 601/157

(56) References Cited

U.S. PATENT DOCUMENTS 3,055,357 A * 9/1962 Redka ..... 601/157
3,837,334 A * 9/1974 Johnson ..... 601/157
3,886,936 A * 6/1975 Wehrenberg ..... 601/157
3,965,495 A * 6/1976 McNair ..... 4/622
4,620,529 A * 11/1986 Kurosawa ..... 601/157
5,537,696 A * 7/1996 Chartier ..... 4/507
2002/0013964 A1 * 2/2002 Kuen ..... 4/622

* cited by examiner

*Primary Examiner*—Charles E. Phillips
(74) *Attorney, Agent, or Firm*—Ohlandt, Greeley, Ruggiero & Perle, LLP

(57) ABSTRACT

A foot massager adapted to hold a fluid that may be deposited from above onto a user's feet including a housing having a foot supporting floor and walls extending upwardly therefrom to form a basin and adapted to hold a fluid. There may be a fluid transport device disposed within the housing and being operatively connected to a fluid inlet disposed in the basin. A pump may be used in the fluid transport device to dispose the fluid out of a fluid outlet to a place disposed above and spaced a distance from the floor of the basin. The fluid outlet and the floor defines a foot receiving space there between whereby the fluid exiting the fluid outlet falls through the foot receiving space and into the basin. There may be a fluid distributor which allows the fluid to fall in a uniform layer to create a waterfall effect.

33 Claims, 5 Drawing Sheets

WATERFALL FOOT MASSAGER

BACKGROUND OF THE INVENTION

The present invention relates to a foot massager and more particularly to a waterfall foot massager that is adapted to hold a fluid that may be deposited from above onto a user's feet.

DESCRIPTION OF THE PRIOR ART

Devices for soothing a massaging one's feet are well known in the art. One particular device includes a portable foot bath or basin that holds water into which one's feet may be placed. Such foot baths typically include a vibrating foot support surface that provides a soothing foot massage. Foot baths may also include a pump mounted within the housing so that the water could be moved within the basin and thereby create a therapeutic current which provides soothing sensations. It is also known to pump air into the basin to agitate the basin fluid and comfort the feet.

U.S. Pat. No. 5,588,161 to Barradas discloses a foot bath having a heated floor. The floor is heated to provide direct heating to the user's feet through the floor and by indirectly warming the feet by warming the water in the foot bath. However, Barradas, does not provide any further soothing to a user's feet besides the sensation of warm water.

U.S. Pat. No. 5,729,841 to Chan discloses a foot massager having a heated floor positioned in a basin so that the user's feet may be covered by water. Chan discloses that the floor may be heated and has a plurality of massaging projections on the floor which move to soothe the user's feet. However, Chan does not soothe the tops of the user's feet or provide relaxing visual stimulation as the user's feet are being massaged.

Foot baths of the prior art fail to address the overall well being of the user. Vibrating motors and swirling water of the prior art devices create disturbing noise making it difficult for one to fully relax. While the vibration and jetted water may provide desirable stimulation to the feet, the user's auditory and visual senses are not addressed.

Accordingly, it would be desirable to provide a foot massager that provides desirable tactile, visual, and auditory sensation to aid in relaxation and provide a feeling of well being.

SUMMARY OF THE INVENTION

It is an advantage of the present invention to provide a foot massager having a waterfall.

It is a further advantage of the present invention to provide a foot massager that provides desirable tactile, visual and auditory sensation to aid in relaxation and provide a feeling of well being for the user.

It is still a further advantage of the present invention to provide a foot massager having a basin adapted to hold a fluid and fluid transport device for moving fluid from the basin to a point above a floor of the basin such that water may fall onto a user's feet positioned in the basin.

In accordance with one form of the present invention the foot massager generally includes a housing having a foot supporting floor and walls extending upwardly therefrom to form a basin adapted to hold a fluid. In the preferred embodiment the fluid is water. Preferably there is a fluid transport device disposed within the housing and being operatively connected to a fluid inlet disposed in the basin.

The inlet is preferably positioned near the floor or on the lower half of the walls so that it is disposed below the top surface of the fluid level. The fluid transport device then after taking the fluid into the fluid inlet disposes the fluid out of a fluid outlet to a place disposed above and spaced a distance from the floor of the basin. The fluid outlet and the floor defines a foot receiving space therebetween whereby the fluid exiting the fluid outlet falls through the foot receiving space and into the basin. There may be a mechanical pump that pumps the fluid from the inlet to the outlet.

The fluid outlet in the preferred embodiment has a fluid distributor which creates a waterfall effect of the fluid falling onto the user's feet and into the basin. In the preferred embodiment the fluid distributor may include a laterally extending slot. The slot may be disposed on a cover, which defines the upper limit of the foot receiving space with the cover covering a portion of the basin. The laterally extending slot or channel may have an upstanding lip on the front edge whereby the fluid fills up behind the lip and then overflows over the lip and falls into the basin to form a generally uniform layer of fluid to fall from the outlet.

In the preferred embodiment the foot massager further includes a vibration actuator for either vibrating the basin floor or the entire massager unit. The foot massage may also include a heating coil for warming the fluid so that it is comfortable to the touch for the user. It is envisioned that the user may be able to control the vibration, heating and waterfall devices independent of each other and may have an option that allows the user to combine any two of the different options.

The present invention may include a center portion in the basin which allows the user to change removable portions of the service of the center portion. The changeable portion of the center portion may allow the users to change the surface so that they may then rub the bottoms of their feet over the changeable surface depending on the attachment used. The attachments may include a pumice stone, roller or a bristle brush. The users may place their feet over the attachment so that they are further relaxed by the soothing sensations on the bottoms of their feet.

The basin of the present invention may include pivotally mounted rollers on the floor to further provide soothing sensations to the bottoms of the user's feet when the massager is in use. These rollers are preferably freely movable and are not actuated by a motor. Another advantage of the present invention is the vibrations from the vibrator actuator may also pass through the rollers positioned on the bottom of the basin.

A preferred form of the foot massager as well as other embodiments, objects, features and advantages of the invention will be apparent from the following detailed description of illustrative embodiments thereof which is to be read in conjunction with the accompanying drawings.

DETAILED DESCRIPTION OF THE PREFERRED EMBODIMENTS

Figure 1:
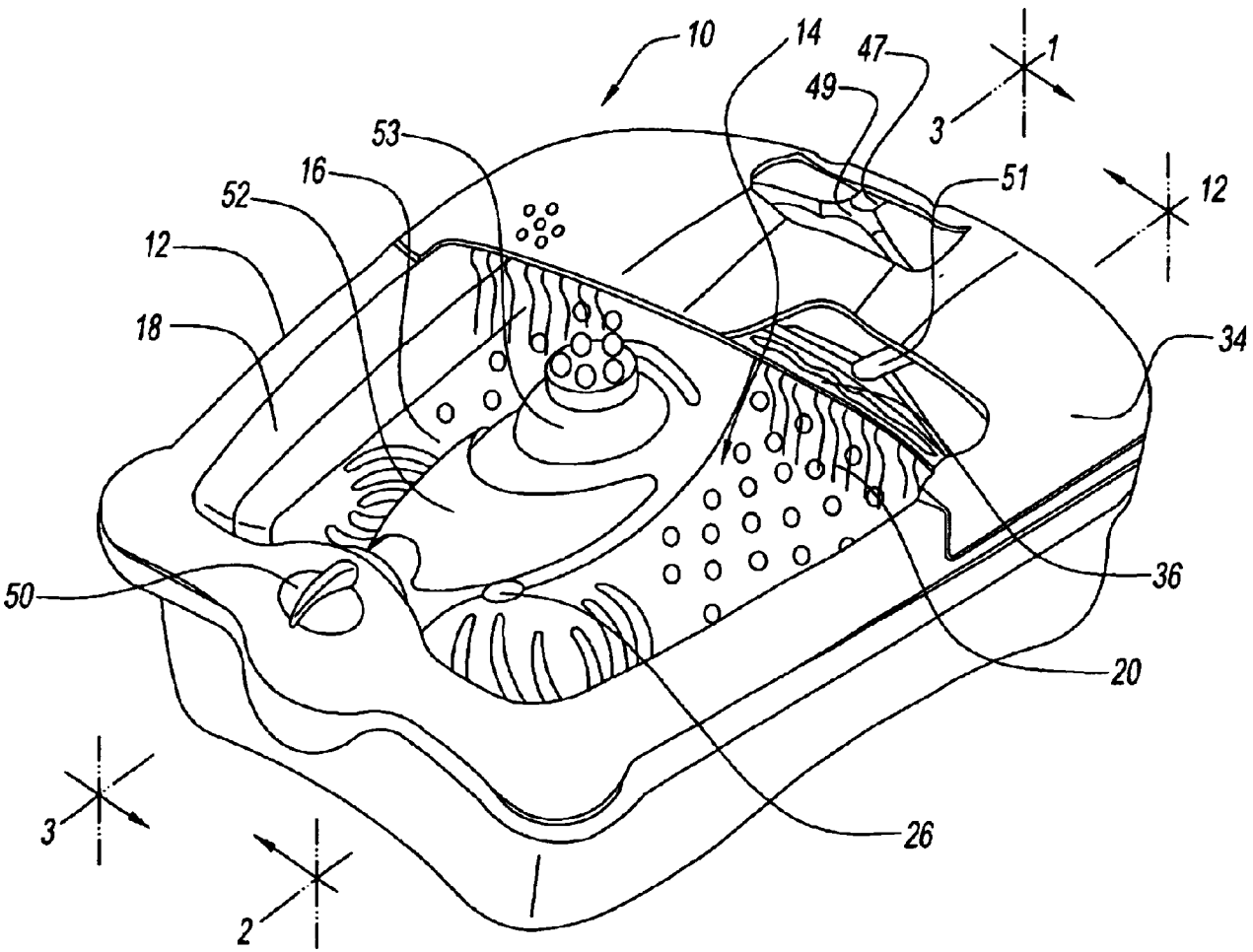
FIG. 1 is a top perspective view of the present invention having a portion cut-away for clarity.

Referring to FIG. 1, the preferred embodiment of the present invention is directed to a foot massager 10 that is adapted to retain a fluid, such as water, and receive a user's feet in the fluid. Foot massager 10 includes a housing 12 having a foot supporting floor 16 and side walls 18 extending upwardly therefrom to define an open basin 14. In the preferred embodiment, basin 14 is of a size sufficient to receive a person's feet generally placed side by side next to each other in basin 14. Foot massager 10 further includes a vibrating motor 13, which may vibrate the basin 14 to provide a stimulating vibration to a user's feet. Foot massager 10 is relatively light weight and may be easily moved for use and storage.

In order to provide soothing visual, auditory and tactile sensations, foot massager 10 further includes a waterfall 20 that deposits fluid from above into the basin and onto a user's feet placed therein. In the preferred embodiment, waterfall 20 is created by transporting fluid held in basin 14 up above a foot receiving space 22 and permitting the water to spill out onto the feet positioned below. The falling water flows over the tops of ones feet creating a pleasant sensation. In addition, the gentle sound and visuals generated by the falling water creates a soothing experience. Accordingly, the present invention does not only sooth one's feet but also aides in overall relaxation.

Figure 2:
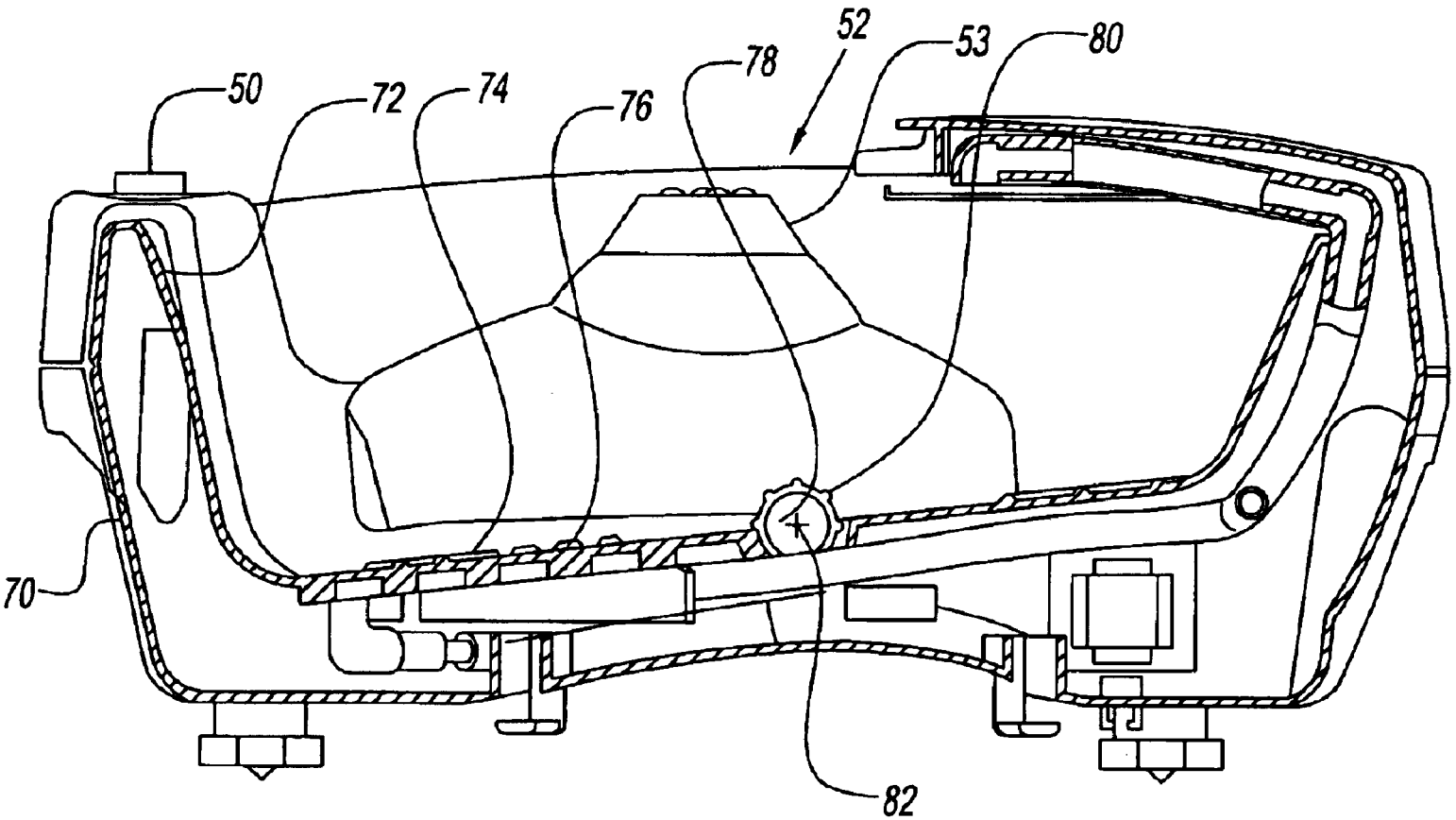
FIG. 2 is a side cross-sectional view of the present invention along line 2—2 of FIG. 1.
Figure 2A:
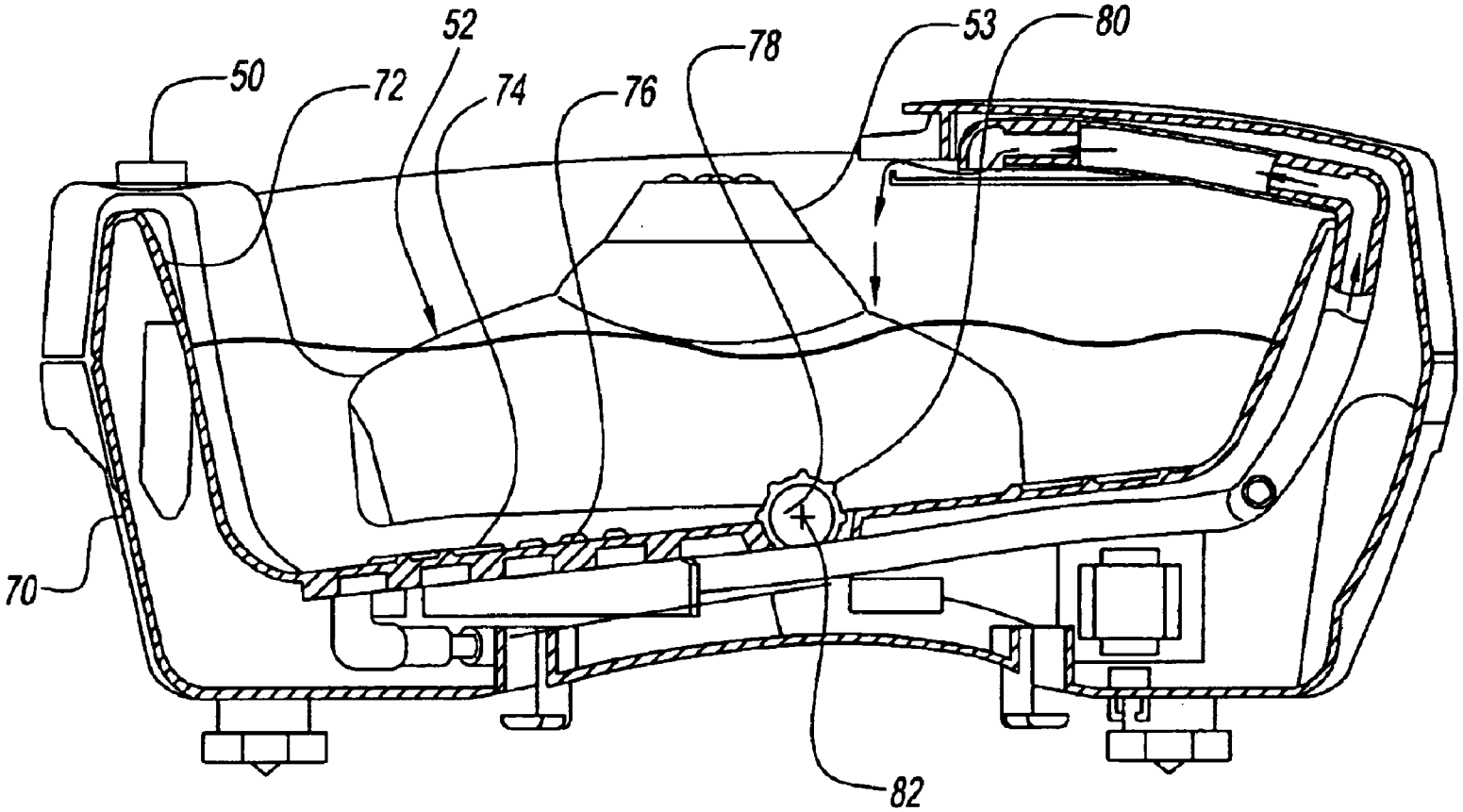
FIG. 2A is a side cross-sectional view of the present invention along line 2—2 of FIG. 1 showing the path of the fluid existing the outlet.

Referring to FIGS. 2 and 2A, in order to create the waterfall effect, the present invention includes a fluid transport device 23 to move the water from the basin 14 to above foot receiving space 22 defined between basin floor 16 and a fluid outlet 47. Preferably, fluid transport device 23 is an electric pump 24 which may be chosen from any one of a number of pumps well known in the art. Pump 24 may be operatively and sealingly connected to a fluid inlet 26 by a inlet passage 28 and to a fluid outlet 47 by outlet passage 30. Fluid inlet 26 is preferably formed in basin floor 16 or a lower portion of the side wall 18 such that it is covered with water during operation. Alternatively, there may be a plurality of inlets formed in basin 14. Preferably, both the inlet passage 28 and the outlet passage 30 are made of a non-corrosive PVC type tubing. Outlet passage 30 extends upward to a point above basin floor 16, such that pump 24 transports the fluid from the basin 14 to above the users feet where it its then deposited into the basin 14 onto the upper surface of the user's feet.

In a preferred embodiment, a cover 34 may be located on the upper end of side walls 18 so that it partially covers basin 14, yet still permits one to place their feet within basin 14. The cover 34 may have fluid outlet 47 positioned thereon. Therefore, in the preferred embodiment fluid outlet 47 and floor 16 define the foot receiving space 22 therebetween such that a user's feet can be inserted into basin 14 and below cover 34 so that water will fall onto one's feet and the water in basin 14.

It is contemplated that in an alternative embodiment, the inlet passage 28 and outlet passage 30 for the fluid may be integrally molded into the housing 12 of the massager. The molding of the passages into the housing of the massager 10 would eliminate the need for separate PVC type tubing and would further facilitate production of the massager. An added advantage of having the fluid passages molded into the housing, is that less parts would be needed for assembly. It is contemplated that the routing of the fluid could take many forms, so long as the fluid which is transported from the basin 14 is later deposited into the basin 14 at a point above the user's feet.

Prior to the water falling into basin 14, the outlet passage 30 terminates to allow the water to exit at fluid outlet 47. In the preferred embodiment, fluid outlet 47 includes a fluid distributor 51 (FIG. 1) that permits the fluid to fan out so that it generally falls in a longitudinal sheet as in a naturally occurring waterfall.

In the preferred embodiment, the fluid distributor 51 may have a split passage which creates a separate water fall for each feet. Referring to FIG. 1, the present invention may have fluid outlet 47 come to a junction 49 that directs the fluid to the fluid distributor 51. There may be one fluid distributor 51 positioned over each of the user's feet to create a dual water fall effect.

Figure 3:
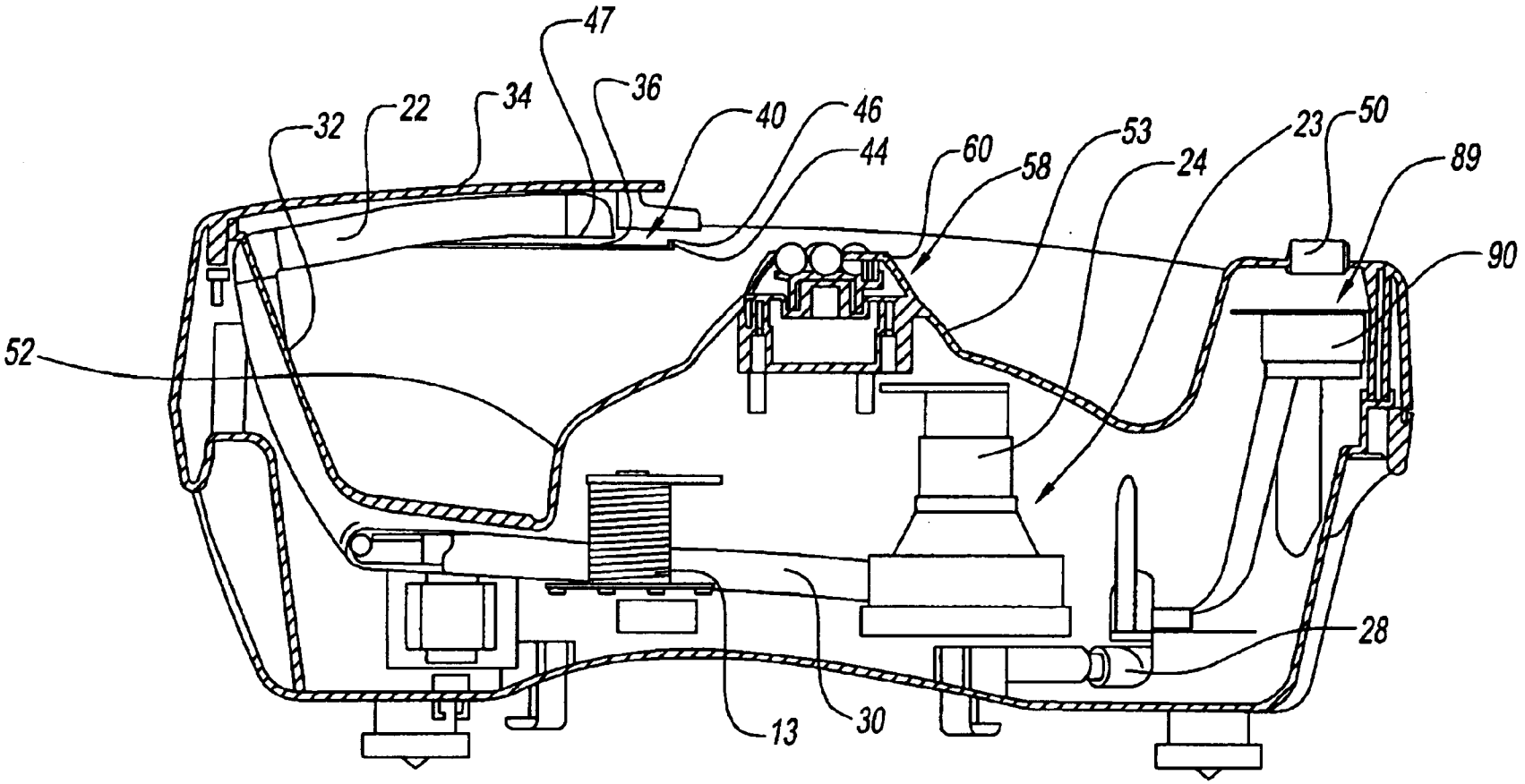
FIG. 3 is a cross-sectional view of the present invention along line 3—3 of FIG. 1.

In an alternative embodiment, fluid distributor 51 may include a waterfall shelf 36 contained in cover 34. As shown in FIG. 3, waterfall shelf 36 includes a trough 40 extending along the length of the waterfall shelf 36. Preferably, the shelf 36 is inclined to facilitate the falling of the fluid from the trough 40. Trough 40 has a bottom portion 42 with upward rising walls 44 to create the trough 40 which has an open space 46. The outlet passage 30 may have an outlet passage opening 48 that is positioned above trough 40 in the open space 46 so that when the fluid exits the opening 48 it fills trough 40 with fluid. The opening 48 may be positioned adjacent to the trough 40 in an alternative embodiment so long as the trough is adequately filled with fluid by the opening 48. The trough 40 has a front lip 46 positioned under the front edge of the waterfall shelf 36. The front lip 46 is formed by one of the upward rising walls 44. When the fluid coming out of the opening 48 fills the trough 40 so that the fluid level in the trough 40 overflows, the fluid will flow over the front lip 46 into the basin 14. Cover 34 is preferably made so that it is aesthetically pleasing to they eye while at the same time hiding the trough 40 and the outlet passage opening 48. Referring to FIG. 2A the present invention shows the path of the fluid exiting fluid distributors 51.

In a further alternative embodiment (not shown), the fluid distributor 51 may include a pair of laterally extending slots integrally formed in the cover 34. Either one slot which extends substantially the width of the cover 34 or a pair of slots positioned on each side of the cover 34 from the center to form an individual waterfall for each foot may be employed. Preferably, the outlet that is connected to the fluid distributor 51 allows the fluid or water to fill the slots with water so that the water is then spread out forming a wide laterally extending fluid output. The water upon spreading laterally then flows over the upwardly extending walls of the slots formed in the cover 34 and then over the front lip 46 of the cover 34.

The foot massager 10 of the present invention also includes a vibration actuator for providing additional massage therapy to the feet. In the preferred embodiment, the vibration actuator may include an eccentric motor 13 placed within the housing. It is preferable that the vibration actuator is positioned such that it evenly distributes a vibrating sensation to the bottoms and sides of the user's feet. Preferably, the entire housing of the massager will vibrate such that any part of the person's feet which may be contacting the basin 14 of the massager 14 may have the sensation of a soothing vibrating massager. The types of eccentric motor 13 that is used for vibration are well known in the art and are not discussed in further detail. In addition, it is within the contemplation of the present invention that other well-known vibration actuators could be employed to provide the desired massage.

Referring now to FIG. 2, the present invention may have a housing 12 having both an outer wall 70 and inner wall 72.

The inner wall 72 forms the actual side walls 18 of the basin 14. In the preferred embodiment, the floor 16 has a textured surface 74. The textured surface 74 may have a plurality of nodes 76 extending upward from the floor 16. Preferably the nodes 76 have a semi-circular cross section to form a stimulating surface for the user's feet. In the preferred embodiment, the nodes 76 are made of a rigid material such as rubber or a hard plastic. One advantage of having the nodes 76 is that when the vibration actuator is activated, the vibrations may pass through the nodes 76 to stimulate and soothe the bottoms of the user's feet. The floor 16 may include a roller 78 with a textured surface so that the users may further soothe their feet by moving their feet within the basin 14. The roller 78 preferably has a textured surface with a plurality of raised nodes 80. The roller 78 may be pivotally mounted to the floor 16 so that the roller 78 may freely rotate around its center axis 82. The user would move their feet over the roller 78 so that it would provide a massaging sensation. In another embodiment, the nodes may be moved by a vibration actuator to provide stimulation for the user's feet (not shown).

The present invention may further include a heating element (not shown) for warming the fluid in the basin. The heating element may be used to warm the fluid in the basin to further soothe the user feet by eliminating the sometimes initial cold feeling that is experienced when using prior foot spas which do not warm the fluid in the basin.

The foot massager of the present invention includes various functions such as the waterfall, vibration, and heating element. These functions may be selectively controlled by a control circuit 89. Control circuit includes a control mechanism 90 connected to control knob 50 which is preferably position in an upper portion of the housing 12 so that it is easily accessed by the user. The control mechanism 90 may be operatively connected to heating element, eccentric motor 13 and pump 24. The control mechanism 90 may allow for various setting such as all options off, vibration only, waterfall only and waterfall and vibration simultaneously. It is envisioned that the heat will always be activated when any of the options are chosen, except when the foot massager is in the off position. The various components may be electrically connected together to achieve the desired control in a manner well known in the art.

Referring to FIGS. 1 and 3, center portion 52 is used to hold various components of the foot massager 10, and includes a foot care station 53. The foot care station 53 is preferably located in the center of the basin 14 to provide easy access for either of the user's feet. The foot care station 53 preferably includes an attachment section 58 positioned on the top to further facilitate its use. The attachment section 58 has selectively removeably supported attachments 60 which may interchange depending on the user's needs. The attachments 60 may include a brush, a roller or a pumice stone.

Th attachments 60 are preferably held in place by a friction fit. The friction fit should be of sufficient strength to hold the attachment 60 in place while the user rubs the bottoms of their feet against the attachment 60. One advantage of the attachment section 58 of the present invention, is that the attachments 60 may be easily changed without the need for any special skills or tools.

Figure 4:
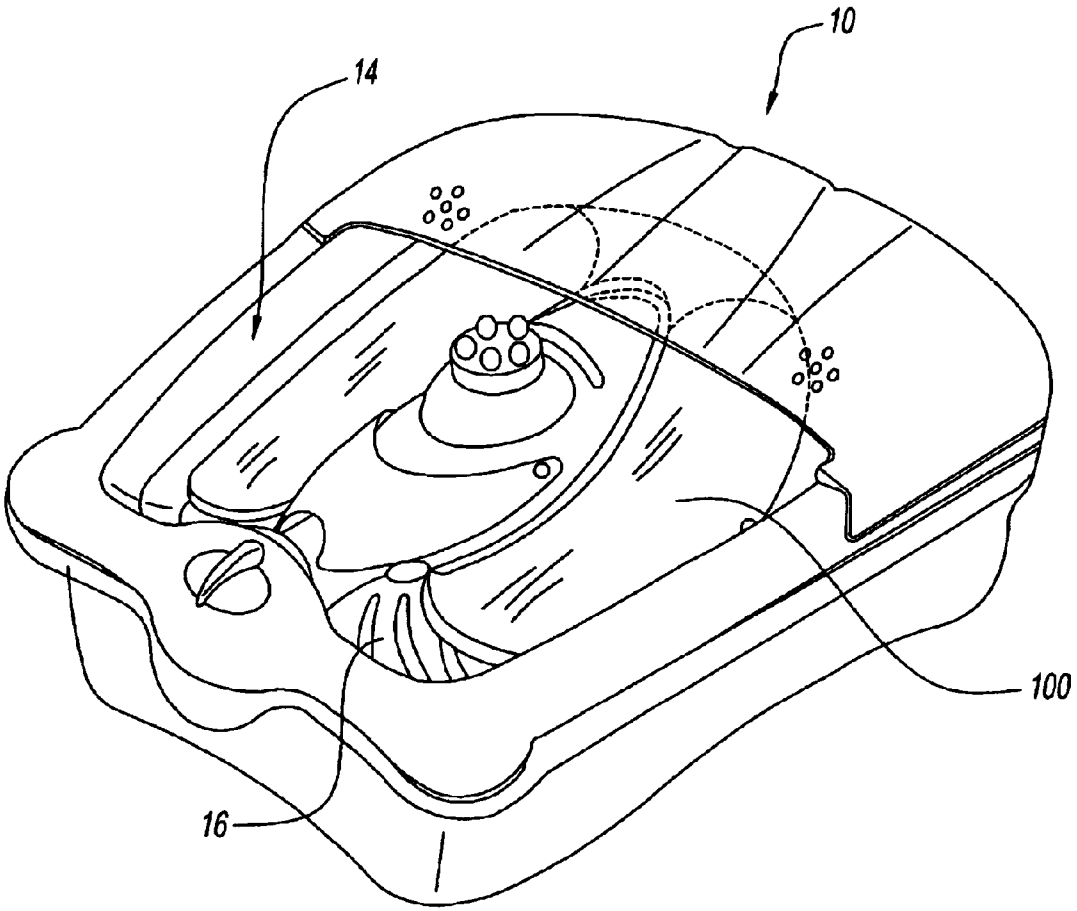
FIG. 4 is a top perspective view of the present invention of FIG. 1 with a gel insert.

Referring to FIG. 4, a cushioning insert 100 may be placed in the basin 14 to further soothe a user's feet. In the preferred embodiment, the cushioning insert 100 can be a gel pad or other cushioning material. Once such material that can be used is Shell Krayton TPE, shore "A" scale, number 13 through 15. Preferably, the cushioning insert 100 is contoured to fit on the basin floor 16 to provide a more cushioned area for a user to put their feet. The cushioning insert 100 may be heated or cooled prior to using by the user by either using heating in a microwave or possibly refrigerating to make cold. The cushioning insert 100 can be used to allow the vibrations from the vibration actuator to be evenly dispersed to the user's feet to increase comfort. In the preferred embodiment the cushioning insert 100 may follow the outer contours of the user's feet to further increase the comfort experienced by the user.

Although an illustrative embodiment of the present invention has been described herein, it is to be understood that the invention is not limited to the precise embodiment and that various other changes and modifications may be effected therein by one skilled in the art without departing from the scope and spirit of the invention.

What is claimed is:

1. A foot massager comprising:

a housing having a foot supporting floor and a plurality of walls extending upwardly therefrom to form a basin of a size sufficient to receive a person's feet generally side-by-side, wherein said plurality of walls hold a fluid for covering said feet;

a cover on an upper portion of said plurality of walls; and a fluid transport device disposed in said housing and being operatively connected to a fluid inlet disposed in said basin and a waterfall disposed on said cover directly above and spaced a distance from said floor of said basin, said waterfall and said floor defining a foot receiving space there between, whereby fluid exiting said waterfall falls through said foot receiving space into said basin.

2. The foot massager of claim 1, wherein the waterfall further includes a fluid distributor for dispersing the fluid prior to exiting the waterfall.

3. The foot massager of claim 2, wherein the fluid distributor further includes a laterally extending slot.

4. The foot massager of claim 3, wherein the fluid distributor includes a laterally extending slot having an upstanding lip wherein fluid may flow from said outlet into said slot and over said lip into the basin.

5. The foot massager of claim 4, wherein said fluid distributor creates a generally uniform layer of fluid to fall from said outlet.

6. The foot massager of claim 5, wherein said fluid distributor further includes a shelf positioned above said basin, said shelf having a top surface and said slot being positioned on said top surface.

7. The foot massager of claim 6, wherein said top surface is at an angle of inclination and said upstanding lip is at the bottom of said angle of inclination.

8. The foot massager of claim 7, wherein said upstanding lip is positioned over said basin and the fluid flowing from the waterfall flows over said upstanding lip to form said uniform layer of fluid.

9. The foot massager of claim 8, further comprising a vibration actuator for vibrating the basin floor.

10. The foot massager of claim 9, wherein said inlet is positioned adjacent to said floor of said basin.

11. A foot massager comprising:

a housing having a foot supporting floor and a plurality of walls extending upwardly therefrom to form a basin of a size sufficient to receive a person's feet generally side-by-side, wherein said plurality of walls hold a fluid for covering said feet;

a cover on an upper portion of said plurality of walls;

a pump being positioned in said housing and being operatively connected to a fluid inlet disposed in said basin;

at least one waterfall being disposed on said cover directly above and spaced a distance from the floor of said basin, wherein the fluid is positioned to fall from said waterfall into said basin; and a vibration actuator being positioned in said housing to vibrate said floor.

12. The foot massager of claim 11, further including a plurality of raised portions positioned on the floor of said housing.

13. The foot massager of claim 12, wherein said raised portions move in relation to said floor and are moved by said vibration actuator.

14. The foot massager of claim 13, wherein said floor includes at least one roller pivotally positioned on said floor, said roller having a textured surface and said roller being movable in relation to said floor.

15. The foot massager of claim 14, further comprising a portion of said floor having a removable changeable portion.

16. The foot massager of claim 15, wherein said changeable position may have a brush attachment, pumice or roller attachment.

17. The foot massager of claim 11, further comprising a cushioning insert positioned on said floor of said basin for supporting a person's feet.

18. The foot massager of claim 17, wherein said cushioning insert is a gel pad.

19. A foot massager comprising:

a housing having a foot supporting floor and a plurality of walls extending upwardly therefrom to form a basin capable of holding a fluid;

a vibration actuator being positioned in said housing to vibrate said floor;

a cushioning insert being positioned on said floor of said basin for supporting a person's feet and dispersing vibrations to said person's feet;

a plurality of nodes, said plurality of nodes extending upward from said floor to provide a stimulating surface for the person's feet;

at least one roller pivotally positioned on said floor, said roller having a textured surface and said roller being moveable in relation to said floor;

a heating element being positioned in said housing to warm the fluid in said basin; and a foot care station being positioned in said basin.

20. The foot massager of claim 19, wherein said cushioning insert is a gel pad.

21. The foot massager of claim 20, wherein said foot care station comprises an attachment section having removably supported attachments.

22. The foot massager of claim 21, wherein said removably supported attachments are selected from the group consisting of a brush, a roller, and a pumice stone.

23. A foot massager comprising:

a housing having a foot supporting floor and a plurality of walls extending upwardly therefrom to form a basin of a size sufficient to receive a person's feet generally side-by-side, wherein said plurality of walls hold a fluid for covering said feet;

a cover on an upper portion of said plurality of walls;

a vibration actuator being positioned in said housing to vibrate said floor;

a cushioning insert being positioned on said floor of said basin for supporting the person's feet and dispersing vibrations thereto;

a heating element being positioned in said housing to warm the fluid in said basin; and at least one waterfall being disposed on said cover directly above and being spaced a distance from the floor of said basin to allow a fluid to fall from said waterfall into said basin.

24. The foot massager of claim 23, wherein said floor comprises a centrally disposed portion dividing said floor into a pair of foot placement sections.

25. The foot massager of claim 23, further comprising a massager member positioned on said floor for creating a messaging section in the person's feet.

26. The foot massager of claim 25, wherein said messaging member is a roller pivotally mounted on said floor.

27. The foot massager of claim 26, wherein said roller has a textured surface.

28. The foot massager of claim 23, wherein said cushioning insert is a gel pad.

29. The foot massager of claim 23, further comprising a foot care station positioned in said basin.

30. The foot massager of claim 29, further comprising a control mechanism having a control circuit operatively connected to said vibration actuator and said heating element and said foot care station.

31. The foot massager of claim 29, wherein said foot care station comprises an attachment section having removably supported attachments.

32. The foot massager of claim 31, wherein said removably supported attachments are selected from the group consisting of a brush, a roller, and a pumice stone.

33. A foot massager comprising:

a housing having a foot supporting floor and walls extending upwardly therefrom to form a basin capable of holding a fluid;

a vibration actuator being positioned in said housing to vibrate said floor;

a gel pad insert being positioned on said floor of said basin for supporting a person's feet and dispersing vibrations to said person's feet;

at least one roller pivotally positioned on said floor, said roller having a textured surface and said roller being movable in relation to said floor;

a heating element being positioned in said housing to warm the fluid in said basin; and a foot care station being positioned in said basin, said foot care station having an attachment section with removably supported attachments selected from the group consisting of a brush, a roller, and a pumice stone.

* * * * *